US007549541B2

(12) United States Patent
Brozell et al.

(10) Patent No.: US 7,549,541 B2
(45) Date of Patent: Jun. 23, 2009

(54) CHILD-RESISTANT COMPACT FOR BLISTER CARD PRODUCTS

(75) Inventors: Leonora M. Brozell, Maumee, OH (US); Brian John Brozell, Maumee, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 658 days.

(21) Appl. No.: 11/190,032

(22) Filed: Jul. 26, 2005

(65) Prior Publication Data

US 2007/0023317 A1 Feb. 1, 2007

(51) Int. Cl.
*B65D 83/04* (2006.01)
*B65D 85/42* (2006.01)

(52) U.S. Cl. ..... 206/531; 206/532; 206/538

(58) Field of Classification Search ..... 206/528–534.2, 206/535–539, 472, 828
See application file for complete search history.

(56) References Cited

U.S. PATENT DOCUMENTS 3,954,179 A 5/1976 Warmath
4,120,400 A 10/1978 Kotyuk
4,746,008 A 5/1988 Heverly et al.
4,817,819 A 4/1989 Kelly
4,890,741 A * 1/1990 Edelstein ..... 206/534
4,890,742 A 1/1990 Allison
5,265,728 A 11/1993 Allendorf et al.
5,267,650 A 12/1993 Gilbilisco
5,275,291 A 1/1994 Sledge
5,346,069 A 9/1994 Intini
5,575,399 A 11/1996 Intini
5,740,938 A 4/1998 Hofmann et al.
5,752,615 A 5/1998 Hofmann et al.
5,915,576 A 6/1999 Robinson
6,021,901 A 2/2000 Wolfe
6,173,838 B1 * 1/2001 Brozell ..... 206/538
6,199,689 B1 * 3/2001 Higuchi et al. ..... 206/308.3
6,349,831 B1 2/2002 Buss
6,626,290 B2 * 9/2003 Byrne et al. ..... 206/308.1
6,679,381 B1 1/2004 Bush
6,789,677 B2 9/2004 Maietta
6,793,077 B1 9/2004 Kancsar et al.
6,805,258 B2 10/2004 Cross
6,824,006 B2 11/2004 Lambelet, Jr.
6,832,686 B2 * 12/2004 Donegan ..... 206/531
6,854,618 B2 2/2005 Harrold
7,150,355 B2 * 12/2006 Coe et al. ..... 206/536
2002/0185404 A1 12/2002 Donegan
2003/0102321 A1 6/2003 Maietta
2004/0045858 A1 3/2004 Harrold
2004/0089668 A1 5/2004 Lambelet, Jr.
2004/0178111 A1 9/2004 Harrold
2004/0188313 A1 9/2004 Tedham (Continued)

*Primary Examiner*—Mickey Yu
*Assistant Examiner*—Melissa L Lalli
(74) *Attorney, Agent, or Firm*—Reising Ethington P.C.

(57) ABSTRACT

A child-resistant compact for dispensing product on blister cards includes a first portion having a first panel hinged to a first clamp for capturing an end of a first blister card, and a second portion having a second panel hinged to a second clamp for capturing an end of a second blister card. The first and second clamps are connected to each other such that the first and second panels form a chamber for enclosing the blister cards. At least one child-resistant latch is on the periphery of the panels for opening one or both panels with respect to the clamps for access to the blister cards.

14 Claims, 8 Drawing Sheets

U.S. PATENT DOCUMENTS

2004/0226853 A1 11/2004 Intini
2004/0256277 A1 12/2004 Gedanke
2005/0011773 A1 1/2005 Intini
2005/0023285 A1 2/2005 Keung
2005/0082194 A1 4/2005 Fry et al.
2005/0087474 A1 4/2005 Killinger

* cited by examiner

CHILD-RESISTANT COMPACT FOR BLISTER CARD PRODUCTS

The present disclosure relates to a child-resistant compact-style container for dispensing product, such as medications or the like, from blister cards.

BACKGROUND AND SUMMARY OF THE DISCLOSURE

U.S. Pat. No. 6,173,838 discloses a compact-style child-resistant package having a case of one-piece integrally molded plastic construction. An edge of a blister card, for dispensing medication or the like, is captured in a clamp formed between opposed sections of the one-piece case. A first panel is hinged to a first clamp section and a second panel is hinged to a second clamp section so that the first and/or second panel can be opened to give access to the blister card within the case. The case includes side push tabs and a front release latch between the panels for child-resistant operation. U.S. Pat. No. 6,021,901 discloses a child-resistant compact-style package that has side latches and a front latch for simultaneous activation to open the package. Although the child-resistant compacts disclosed in the noted patents present significant improvements over packages theretofore extant in the art, further improvements remain desirable. A general object of the present disclosure is to provide a child-resistant compact for dispensing product on blister cards having improved strength and rigidity in the opposed panels that form the case of the compact, and/or that provides improved alignment between the panels of the case as the panels are closed.

The present disclosure embodies a number of aspects that can be implemented separately from or in combination with each other.

A child-resistant compact for dispensing product on blister cards, in accordance with one aspect of the present disclosure, includes a first portion having a first panel hinged to a first clamp for capturing an end of a first blister card, and a second portion having a second panel hinged to a second clamp for capturing an end of a second blister card. The first and second clamps are connected to each other such that the first and second panels form a chamber for enclosing the blister cards. At least one child-resistant latch is on the periphery of the panels for opening one or both panels with respect to the clamps for access to the blister cards. The first and second portions of the compact preferably are of integrally molded plastic construction, either separate from or integrally with each other. The at least one child-resistant latch preferably includes a first latch at an end of the compact opposite from the clamps and second latches on opposite sides of the compact, preferably requiring simultaneous activation to open the compact. The panels preferably include a guide adjacent to the first latch for aligning the panels as the compact is closed to facilitate interengagement of the latch elements on the panels.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

FIGS. 1-13 illustrate a child-resistant compact 40 in accordance with one exemplary embodiment of the disclosure.

Figure 1:
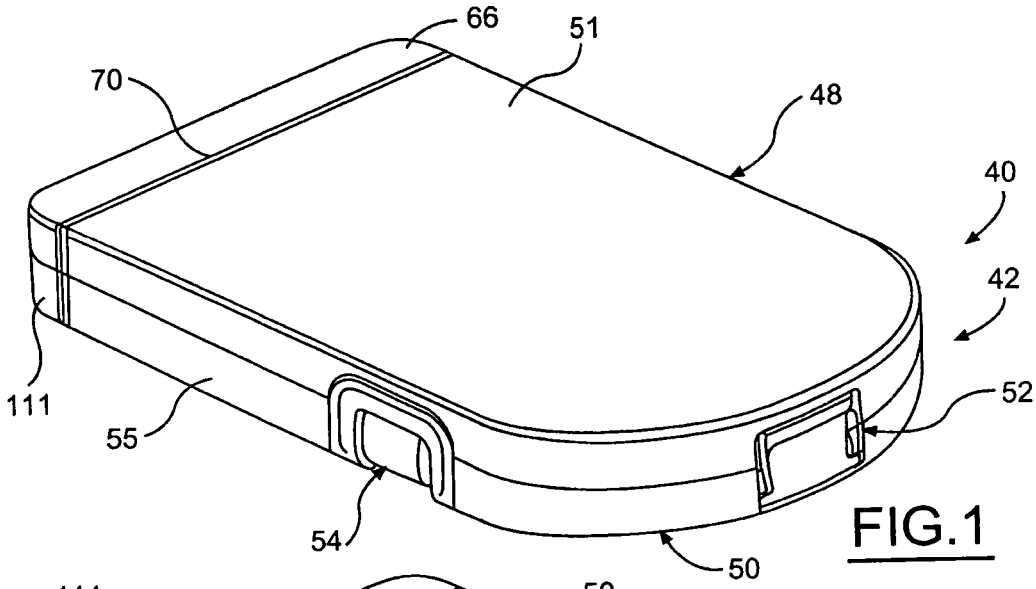
FIG. 1 is a front elevational view of a child-resistant compact in accordance with an exemplary embodiment of the present disclosure.
Figure 2:
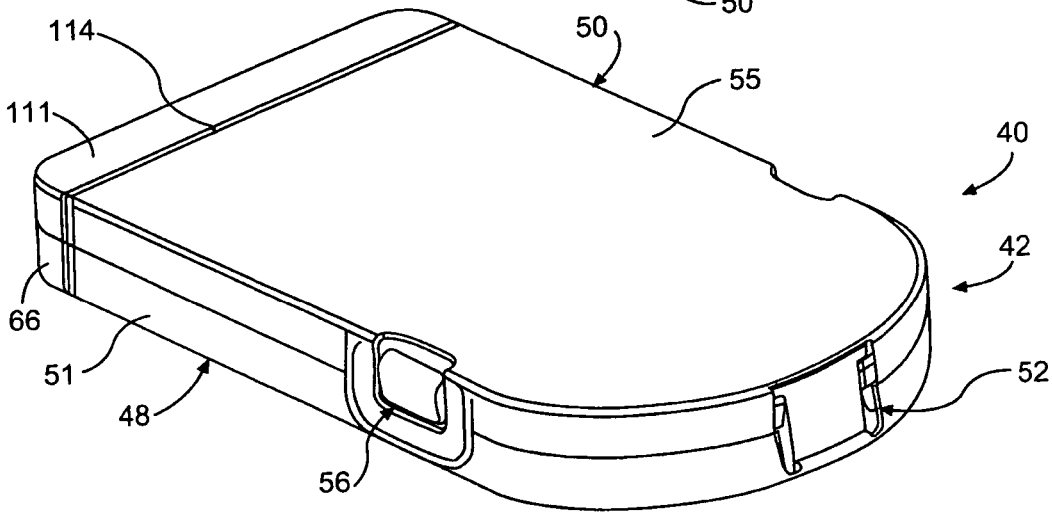
FIG. 2 is a perspective view of the compact of FIG. 1 in inverted orientation.
Figure 3:
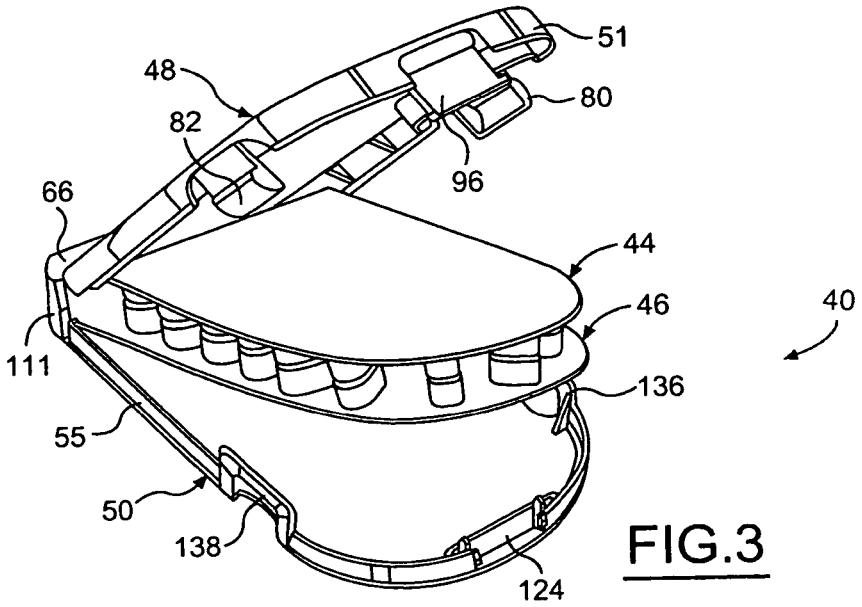
FIG. 3 is a perspective view of the compact in FIG. 1 with the panels open.
Figure 4:
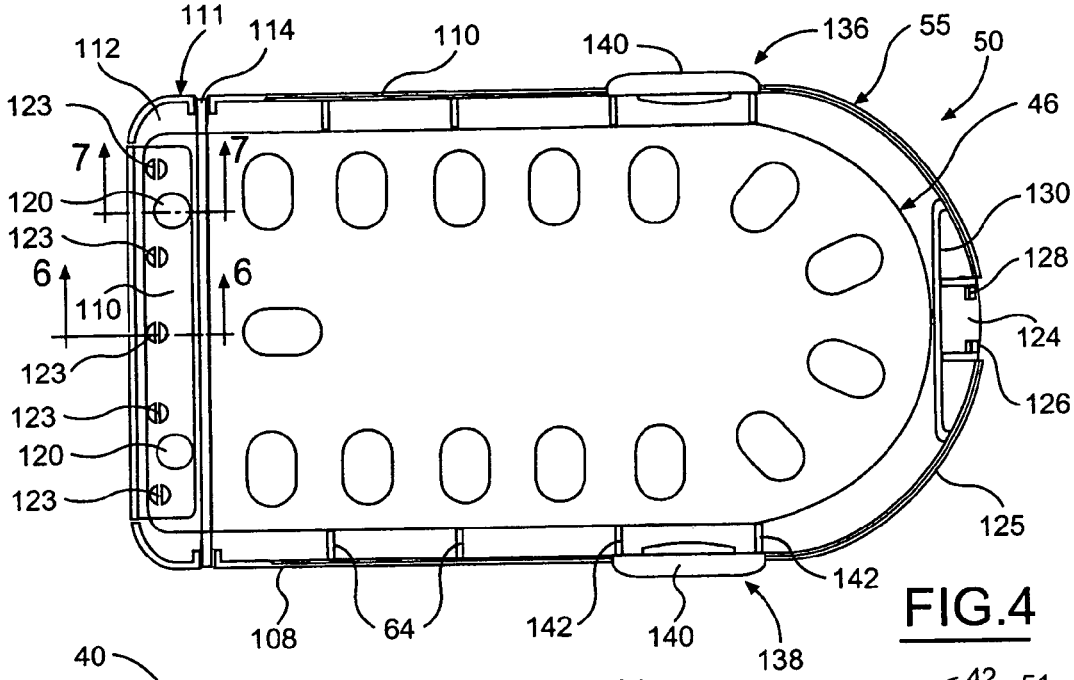
FIG. 4 is a top plan view of the compact of FIG. 1 with the first or upper portion of the compact removed.
Figure 5:
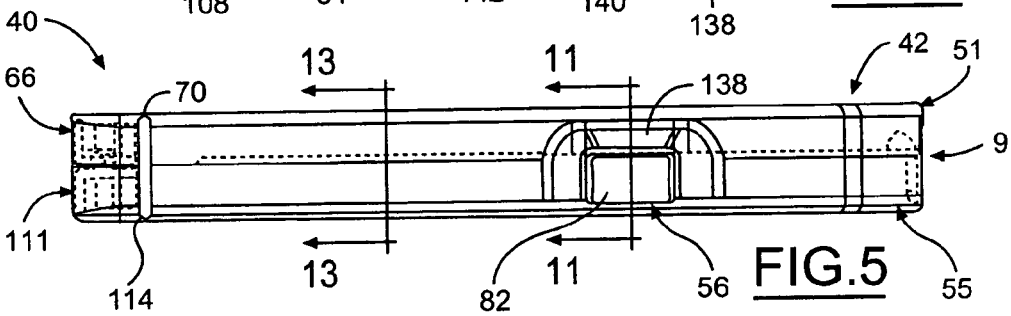
FIG. 5 is a side elevational view of the compact in FIG. 1.

Compact 40 includes a container or case 42 in which there are disposed a pair of blister cards 44,46 that contain dispensable product, such as medication or the like in tablet form. Case 42 includes a first or top portion 48 and a second or bottom portion 50 that are secured to each other along the back edge of the case. (The terms "top" and "bottom" are employed by way of description and not limitation with respect to the upright orientation of the compact as illustrated in FIGS. 1, 3 and 5. The term "compact" is employed by way of description to refer to a package of a size similar to a cosmetic compact or the like.) First portion 48, in the exemplary embodiment of FIGS. 1-3, includes a first clamp 66 connected by a linear hinge 70 to a first panel 51. Second portion 50 in this embodiment includes a second clamp 111 connected by linear hinge 114 to a second panel 55. Clamps 66, 111 are interconnected so that panels 51, 55 can be opened along hinges 70, 114, as shown in FIG. 3, to provide access to the blister cards. At least one child-resistant latch holds panels 51, 55 in the closed position (FIGS. 1 and 2). In the exemplary embodiment of FIGS. 1-13, there are a front latch 52 and a pair of opposed side latches 54, 56 that releasably hold first and second panels 51, 55 in the closed position illustrated in FIGS. 1-2 and 5-13. The overall size of compact 40 preferably is such that latches 54, 56 can be actuated simultaneously by one hand of an adult.

Figure 7:
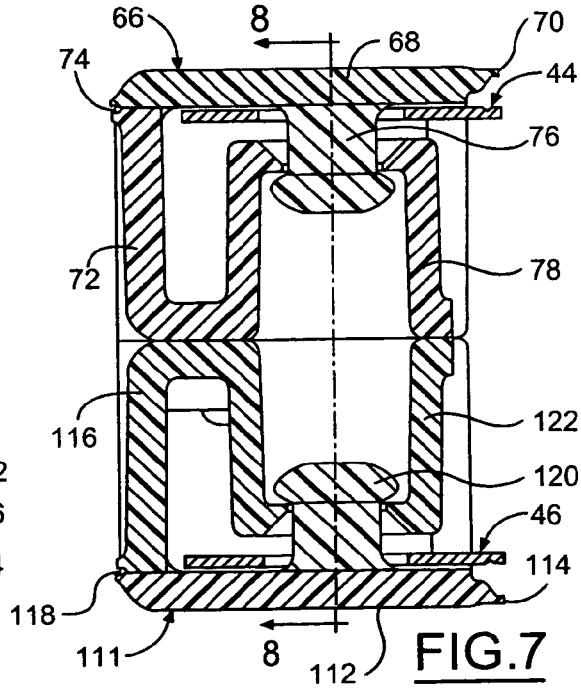
Figure 8:
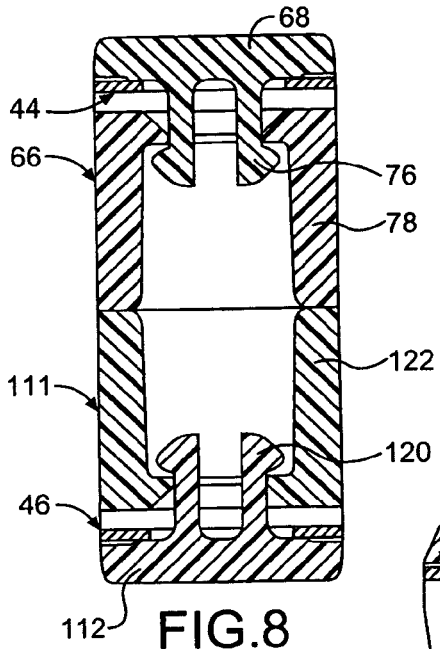
FIG. 8 is a fragmentary sectional view taken substantially along the line 8-8 in FIG. 7.
Figure 9:
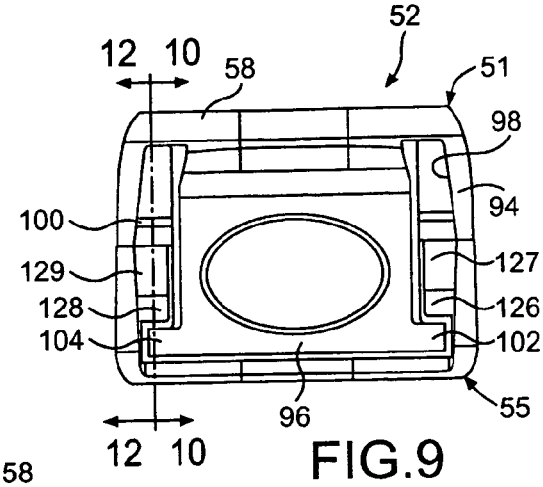
FIG. 9 is a fragmentary front elevational view taken substantially from the direction 9 in FIG. 5.
Figure 10:
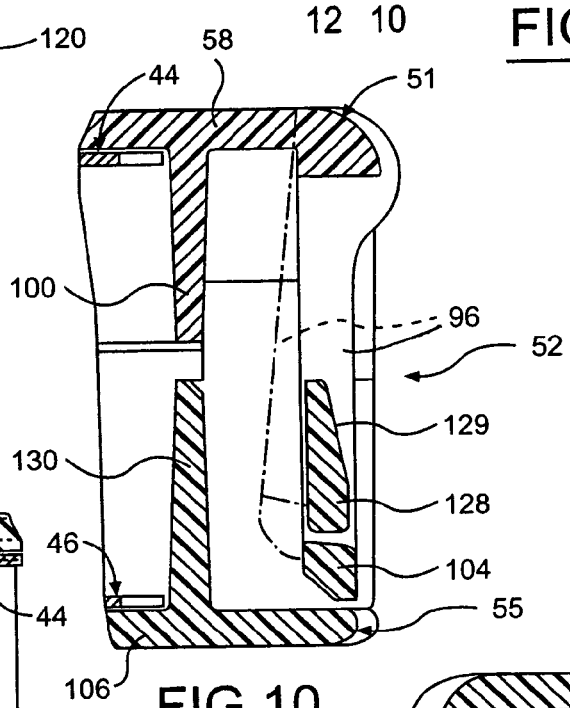
FIG. 10 is a fragmentary sectional view taken substantially along the line 10-10 in FIG. 9.
Figure 11:
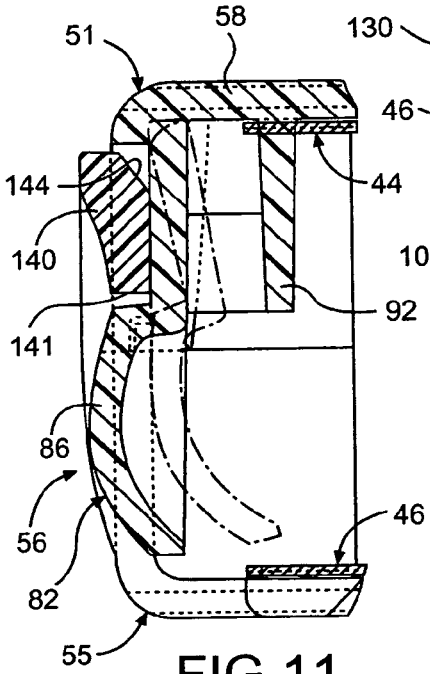
FIG. 11 is a fragmentary sectional view taken substantially along the line 11-11 in FIG. 5.
Figure 15:
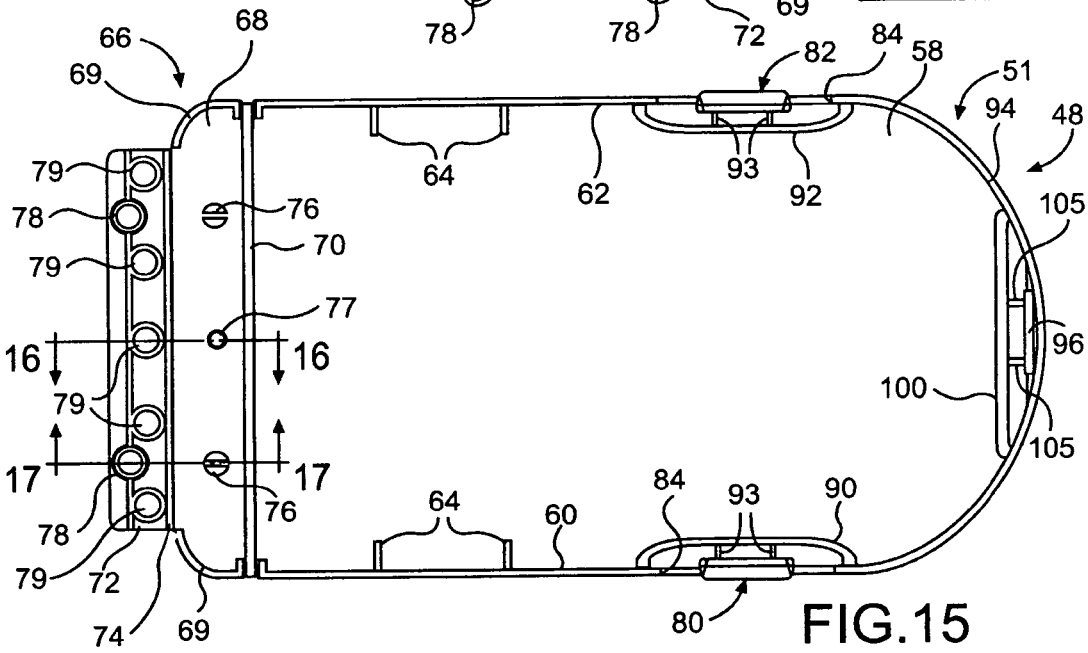
FIG. 15 is an elevational view of the first portion of the compact illustrated in FIG. 14.
Figure 16:
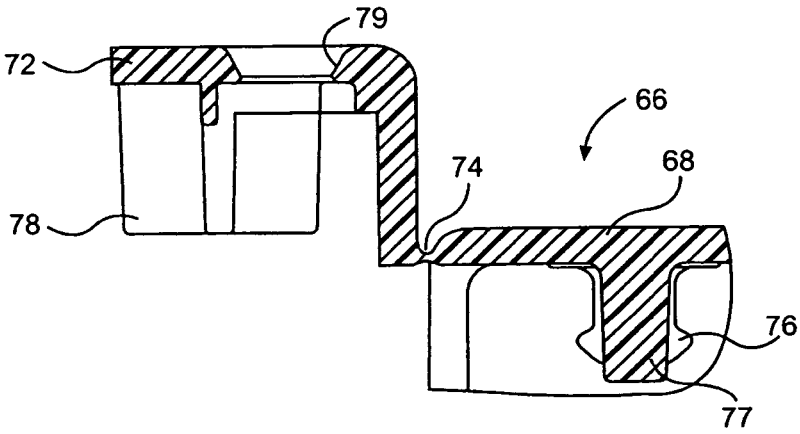
FIGS. 16 and 17 are fragmentary sectional views taken substantially along the respective lines 16-16 and 17-17 in FIG. 15.
Figure 17:
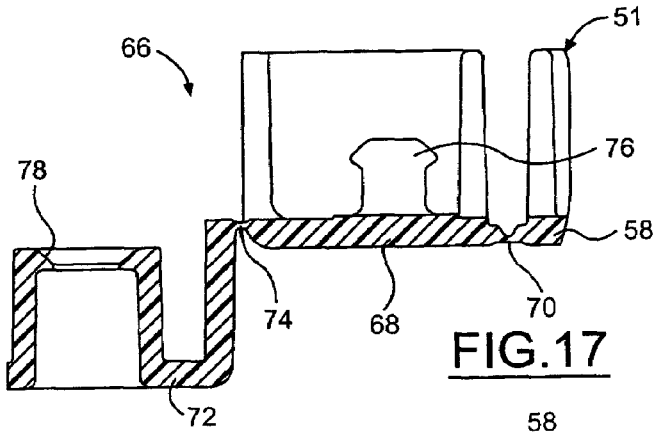
Figure 18:
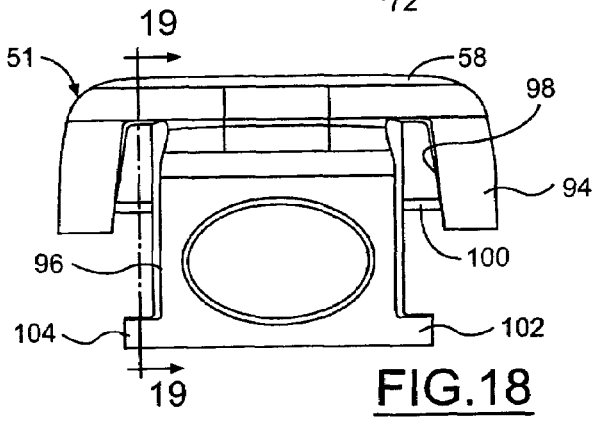
FIG. 18 is a front elevational view of the first latch element on the first portion of the compact illustrated in FIGS. 14-15.
Figure 19:
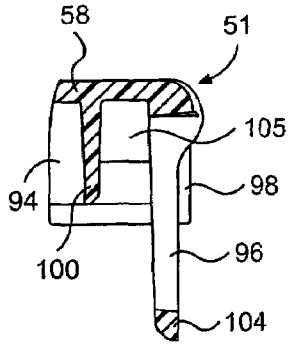
FIG. 19 is a fragmentary sectional view taken substantially along the line 19-19 in FIG. 18.
Figure 20:
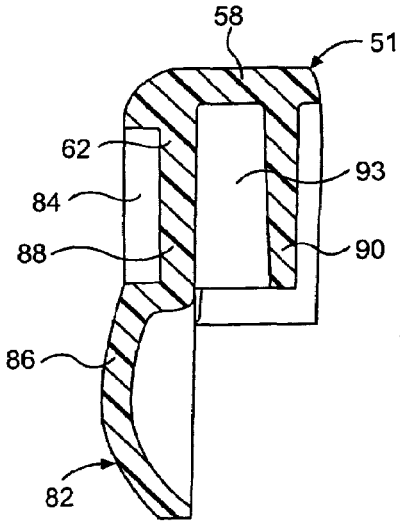
FIG. 20 is a fragmentary sectional view taken substantially along the line 20-20 in FIG. 14.

First or top case portion 48 is illustrated in detail in FIGS. 14-20. Panel 51 preferably includes a generally flat base wall 58 of generally rectangular construction, but preferably having a rounded front end as shown. A pair of opposed sidewalls 60,62 extend along the side edges of base wall 58, and preferably are parallel to each other and supported and stiffened by longitudinally spaced internal gussets 64. First clamp 66 is formed along the back edge of base wall 58, including a first clamp member 68 integrally joined to base wall 58 by hinge 70 and a second clamp member 72 integrally joined to first clamp member 70 by a linear hinge 74. Clamp members 68, 72 are generally rectangular and parallel to each other, as best seen in FIG. 15, along axes lateral to the front-to-back axis of first case portion 48. First clamp member 68 includes at least one clamp element, preferably in the form of a pair of laterally spaced split pegs 76. (Directional words such as "laterally" are employed by way of description and not limitation with respect to the back-to-front dimension of the case and compact, with the "back" being at the clamps 66, 111 and the "front" being at the end opposite to the clamps.) Second clamp element 72 includes at least one clamp member, preferably in the form of laterally spaced sockets 78 that are longitudinally aligned with associated pegs 76. When second clamp element 72 is folded along hinge 74 over first clamp element 68, as shown in FIG. 7, sockets 78 cooperate with pegs 76 to capture blister card 44 on first portion 48. A peg 77 limits pivotal motion of second clamp element 72 into first clamp element 68. Clamp element 72 preferably also includes laterally spaced apertures 79 that cooperate with pegs on second section 50 to assemble the compact, as will be described. First clamp element 68 has sidewalls 69 to enclose second clamp element 72 in such folded position to present a uniform outer appearance.

A pair of laterally opposed latch arms 80, 82 extend from base wall 58 through associated recesses 84 in sidewalls 60, 62. Recesses 84 help isolate latch arms 80, 82 from the remainder of panel 51 as the arms are bent inwardly, as will be described. Each latch arm 80, 82 includes an outwardly convex wall portion 86 (FIG. 20) connected to base wall 58 by a flexible resilient hinge portion 88. A reinforcing wall 90,92 (FIGS. 14-15 and 20) extends behind each latch arm 80, 82 to interconnect the spaced portions of sidewalls 60, 62, and thus to strengthen the sidewalls as well as base wall 58 around latch arms 80, 82 against bending when the latch arms are actuated. Walls 90,92 are integral with side walls 60,62 and are integral with base wall 58. A pair of spaced ribs 93 (FIGS. 15 and 20) preferably extend from each latch arm wall 88 to the associated reinforcing wall 90 or 92, integrally with base wall 58, to reinforce the latch arms. An arcuate end wall 94 integrally extends between sidewalls 60,62 in this embodiment having a rounded front end. (End wall 94 could be straight or of other suitable geometry without departing from the disclosure in its broadest aspects.) A latch arm 96 is disposed within a gap 98 in end wall 94 and is integrally connected to base wall 58. A reinforcing wall 100 extends behind latch arm 96, being integral with both sides of end wall 94 as well as the adjacent portion of base wall 58, to strengthen panel 51 against bending upon activation of latch arm 96. A pair of tabs 102, 104 (FIG. 18) extend laterally from the end of latch arm 96 remote from base wall 58. A pair of spaced ribs 105 (FIGS. 15 and 19) preferably extend between wall 100 and latch arm 96, adjacent to and integrally with base wall 58, to strengthen the latch arm. An internal shoulder 107 (FIG. 13) preferably extends around the periphery of panel 51.

Second case portion 50 (FIGS. 21-26) is to some extent a mirror image of first portion 48 (FIGS. 14-20). Thus, panel 55 of second portion 50 includes a generally flat base wall 106 with parallel sidewalls 108,110 strengthened by gussets 64. Second clamp 111 includes a first clamp element 112 integrally joined to base wall 106 by linear hinge 114, and a second clamp element 116 integrally joined to first clamp portion 112 by a linear hinge 118. Clamp elements 112, 116 are generally rectangular and include associated split pegs 120 and sockets 122 so that clamp 111 captures blister card 46 when clamp element 116 is folded along hinge 118 and sockets 122 encompass split pegs 120 (FIG. 7). A peg 121 (FIGS. 6 and 21-22) limits motion of second clamp element 116 into first clamp element. First clamp element 112 has sidewalls 119 to enclose second clamp element in the folded position to present a uniform outer appearance. Split pegs 123 (FIGS. 6, 22 and 23) on clamp element 116 are adapted to be received in sockets 79 (FIGS. 6, 15 and 16) to secure first and second portions 48, 50 to each other and thereby form case 42.

Figure 21:
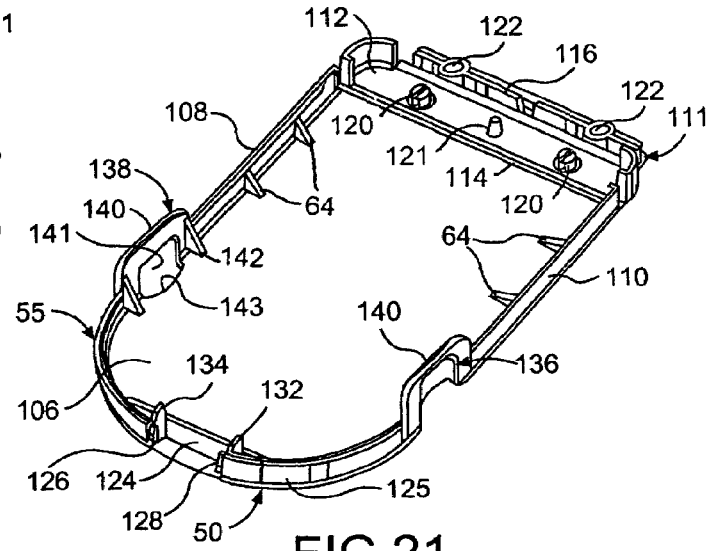
FIG. 21 is a perspective view of the second or bottom portion of the compact case illustrated in FIG. 1.
Figure 22:
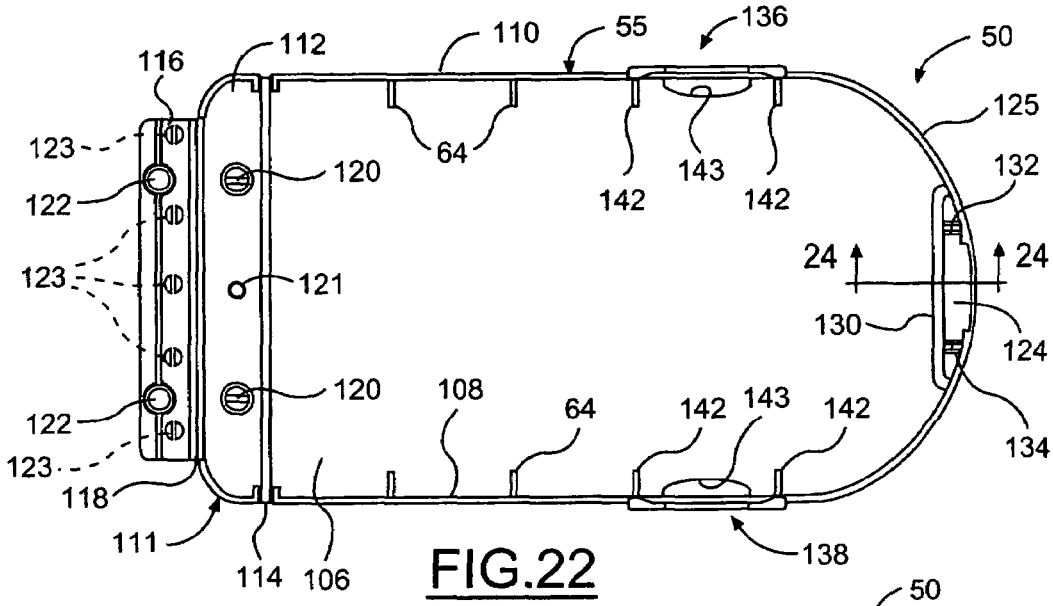
FIG. 22 is a plan view of the compact case portion illustrated in FIG. 21.
Figure 23:
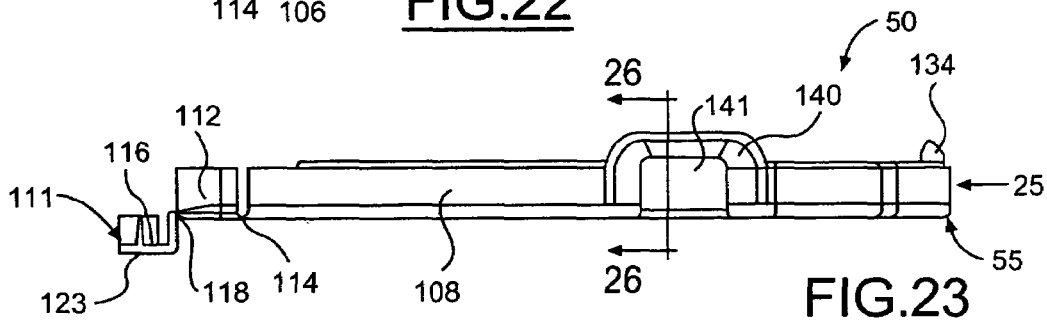
FIG. 23 is a side elevational view of the compact portion illustrated in FIG. 22.
Figure 24:
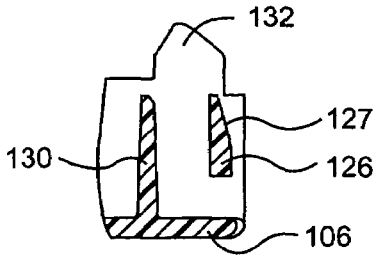
FIG. 24 is a fragmentary sectional view taken substantially along the line 24-24 in FIG. 22.
Figure 25:
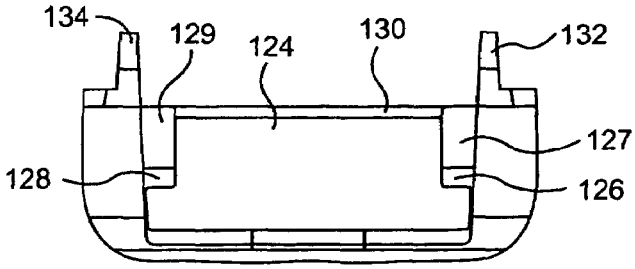
FIG. 25 is a fragmentary elevational view taken from the direction 25 in FIG. 23.
Figure 26:
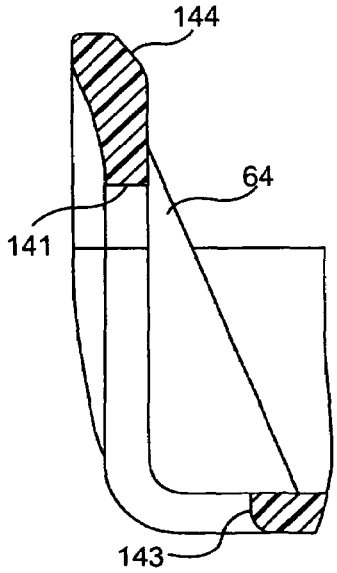
FIG. 26 is a fragmentary sectional view taken substantially along the line 26-26 in FIG. 23.
Figure 27:
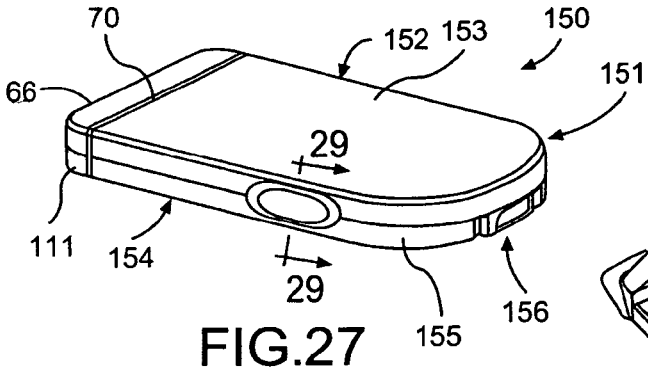
FIG. 27 is a perspective view of a child-resistant compact in accordance with a second exemplary embodiment of the disclosure.

There is a recess 124, at the (preferably arcuate) front end wall 125 of case portion 50. A pair of laterally spaced latch tabs 126, 128 are opposed to each other across recess 124. Tabs 126, 128 have forwardly facing inclined cam surfaces 127, 129 (FIGS. 24 and 25). A reinforcing wall 130 bridges recess 124 and is integrally joined to base wall 106 to strengthen the front end of second case portion 50. A pair of laterally spaced guide post 132,134 extend from recess 124 at positions respectively outward from latch tabs 126,128 but within end wall 125. A pair of latch pockets or recesses 136, 138 are laterally spaced and opposed to each other in sidewalls 110, 108 respectively. Each latch recess 136, 138 is formed by a U-shaped wall section 140 that has an open center 141. Open center 141 also opens at 143 in base wall 106 at each recess 136, 138. The side portions of wall sections 140 are connected to sidewalls 108, 110 and braced by gussets 142 against bending with respect to the sidewalls and base wall 106. Gussets 142 are internally integral with base wall 106 and each associated side portion of wall section 140, as best seen in FIGS. 21, 22 and 26. The inside upper edges of wall sections 140 preferably are angled, as best seen at 144 in FIG. 26, to form cam surfaces for engagement by latch arms 80, 82 on panel 51. An external shoulder 145 (FIG. 13) preferably extends around panel 55.

Figure 6:
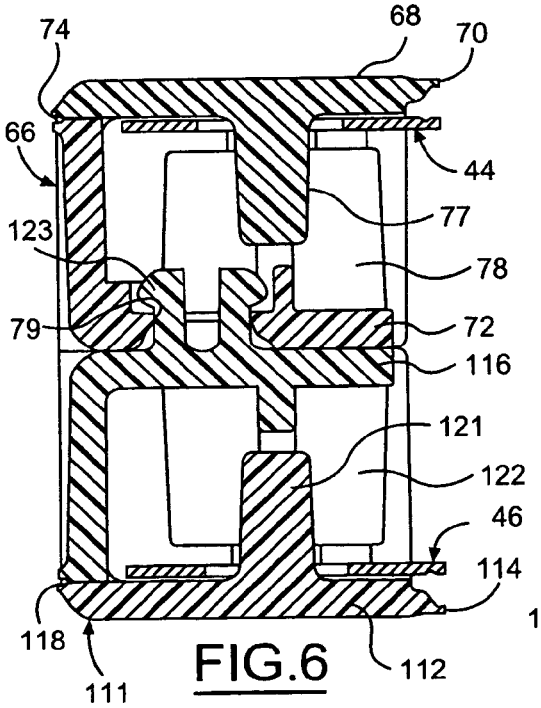
FIGS. 6 and 7 are fragmentary sectional views taken substantially along the respective lines 6-6 and 7-7 in FIG. 4.

In the embodiment of FIGS. 1-26, portions 48, 50 of case 42 preferably are of respectively separate integrally molded plastic constructions. In assembly, blister card 44 is located over pegs 76 and 77 on first portion 48, and second clamp element 72 is folded along hinge 74 until sockets 78 engage pegs 76 to capture blister card 44 as illustrated in FIG. 7. Likewise, blister card 46 is assembled over split pegs 120 on second case portion 50, and clamp element 116 is folded along hinge 118 to clamp blister card 46 in position (FIG. 7). Clamps 66, 111 are then aligned and pegs 123 on clamp 111 are inserted into sockets 79 on clamp 66, as shown in FIG. 6, to lock the clamps and case portions together. Thus, the upper and lower case portions, with the blister cards assembled thereto, are connected to each other while panels 51, 55 are free to pivot around hinges 70, 114.

Figure 12:
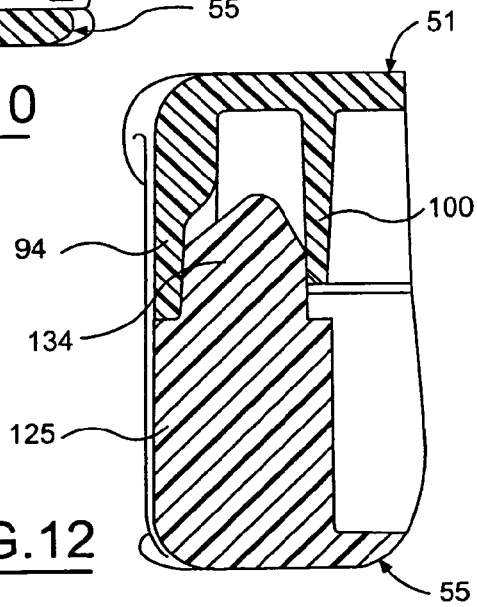
FIG. 12 is a fragmentary sectional view taken substantially along the line 12-12 in FIG. 9.
Figure 13:
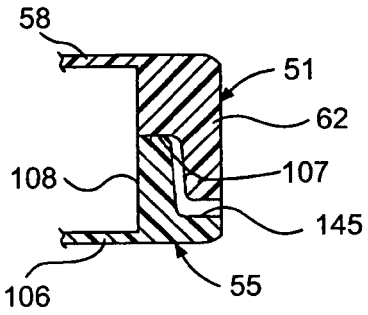
FIG. 13 is a fragmentary sectional view taken substantially along the line 13-13 in FIG. 5.
Figure 14:
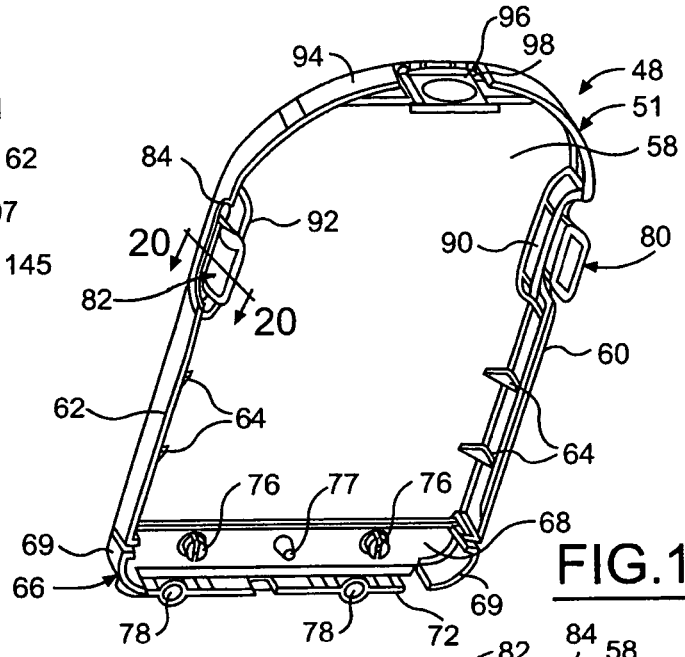
FIG. 14 is a perspective view of the first or top portion of the case of the compact in FIG. 1.

As panels 51, 55 are closed against each other, from the open position of FIG. 3 to the closed position of FIGS. 1 and 4-13, guide posts 132, 134 on panel 55 are received between walls 94, 100 on panel 51 (FIG. 12). The free ends of posts 132, 134 preferably are angled at both front and back, as best seen in FIGS. 12 and 24, so that engagement between the guide posts and wall 94 or 100 will cam panels 51, 55 into longitudinal alignment and thereby promote engagement at the latches. Tabs 102, 104 on latch arm 96 ride along outer cam surfaces 127, 129 on latch tabs 126, 128, camming latch arm 96 outwardly until tabs 102,104 snap beneath the lower edges of tabs 126, 128. In this respect, front latch 52 operates in the manner disclosed in U.S. Patent document 2005/0023285A1, the disclosure of which is incorporated herein by reference. At the same time, the convex wall portions 86 of latch arms 80, 82 on first case portion 48 engage and are cammed inwardly by cam surfaces 144 on wall portions 140 until convex wall portion 86 on each latch arm 80, 82 snaps into recesses 136, 138. Support walls 90, 92, 100 on panel 51, and support wall 130 and gussets 142 on panel 55 restrain the respective panels against bending at the latch elements.

To open compact 40, front latch 52 and side latches 54, 56 must be released simultaneously. Front latch 52 is released by pressing latch arm 96 inwardly, from the position shown in solid in FIG. 10 to the position shown in phantom wherein tabs 102, 104 on latch arm 96 clears tabs 126, 128 on panel 55. Latch 56 (and latch 54) is released when latch arm 82 is pushed inwardly from the position shown in solid lines to the position shown in phantom in FIG. 11. Latch arm 96 may then be pushed upwardly, with tabs 102, 104 behind tabs 126, 128, and/or panel 55 pulled downwardly to open panels 51, 55. Consumer instructions to open the package can be molded, printed or applied as a label to one or both panels 51, 55.

Figure 31:
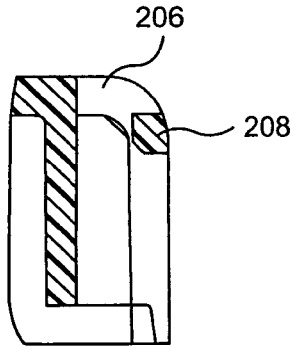
FIGS. 30 and 31 are fragmentary sectional views taken substantially along the respective lines 30-30 and 31-31 in FIG. 28.
Figure 30:
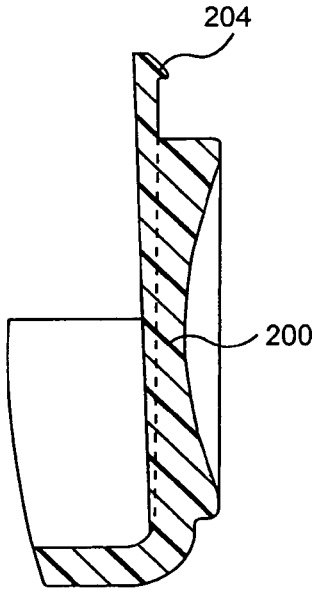

FIGS. 27-30 illustrate a compact 150 in accordance with a second exemplary embodiment of the present disclosure. Compact 150 includes a case 151 having a first or top portion 152 and a second or bottom portion 154, each of which includes a clamp 66, 111 as previously described to capture associated blister cards 44, 46. First case portion 152 has a panel 153 connected to clamp 66 by a linear hinge 70. Second case portion 154 includes a panel 155 connected to clamp 111 by a linear hinge 114. A front latch 156 of compact 150 is similar to front latch 52 previously described, although latch arm 158 integral with panel 153 is an extension of end wall 194 rather than being separated from the end wall as in the embodiment of FIGS. 1-26. In compact 150, the side latches 196, 198 include latch arms 200, 202 on panel 155 that are extensions of panel sidewalls 110, 108, rather than being separated from the sidewalls as in the embodiment of FIGS. 1-26. The ends of latch arms 200, 202 include lugs 204 (FIGS. 29 and 30) that are received into openings 206 (FIGS. 29 and 31) on panel 153 and by snap-fit over ledges 208. Thus, as in the embodiment of FIGS. 1-27, front latch arm 158 must be pushed inwardly simultaneously with inward movement of side latch arms 200, 202 to open panel 153 and/or panel 155 and obtain access to blister cards 44, 46.

Figure 28:
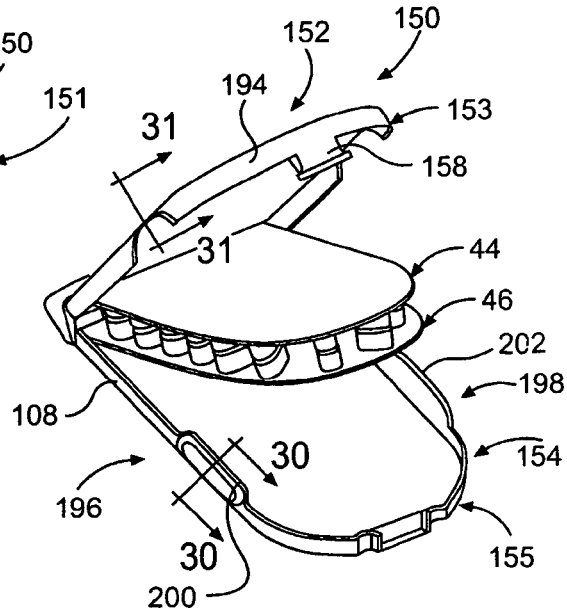
FIG. 28 is a perspective view of the compact illustrated in FIG. 27 with the panels open.
Figure 29:
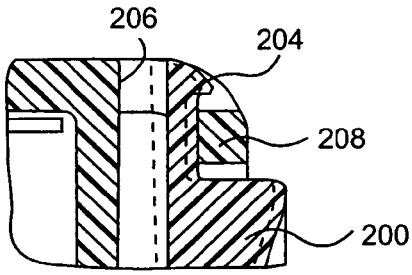
FIG. 29 is a fragmentary sectional view taken substantially along the line 29-29 in FIG. 27.
Figure 32:
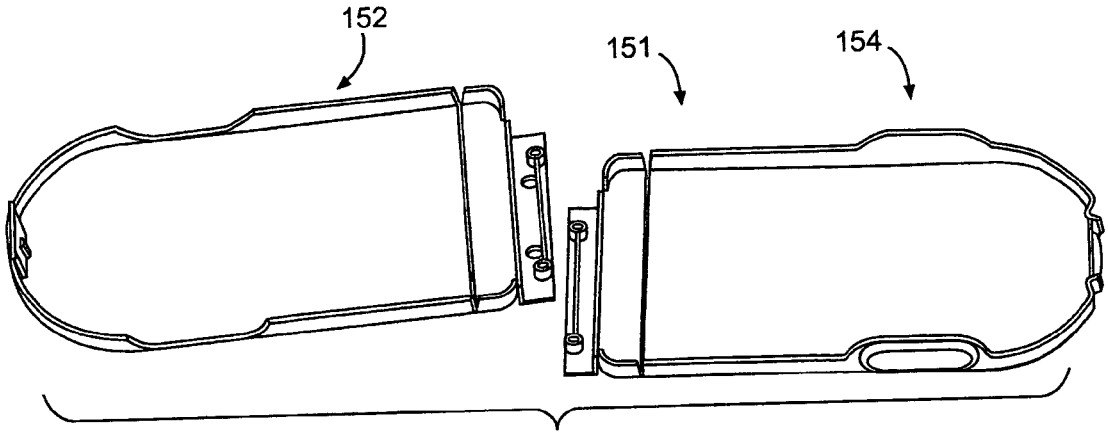
FIG. 32 is a perspective view of a case in the embodiment of FIGS. 27-31 of two-piece molded plastic construction.
Figure 33:
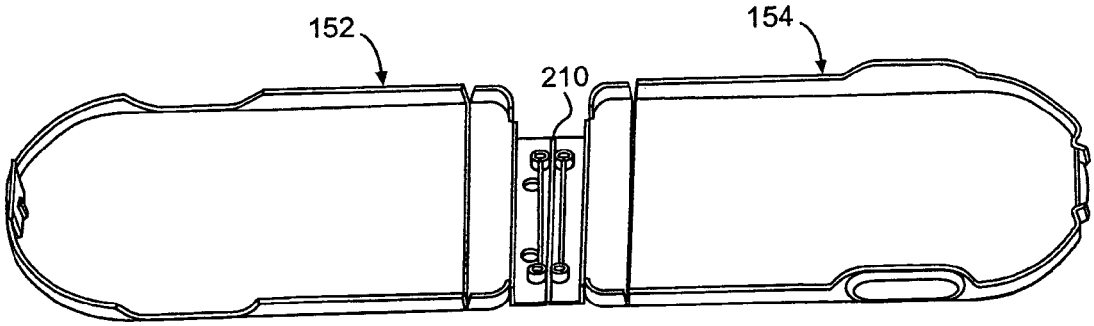
FIG. 33 is a perspective view of a case in the embodiment of FIGS. 27-31 of alternative one-piece integrally molded plastic construction.

FIG. 32 illustrates an embodiment in which first case portion 152 and second case portion 154, in case 151 of FIG. 28, are of separate integrally molded plastic constructions. FIG. 33 illustrates a modification in which first case portion 152 and second case portion 154 are of one-piece integrally molded plastic construction connected by a linear hinge line 210. This type of one-piece construction also could be used in the embodiment of FIGS. 1-26.

There thus has been disclosed a child-resistant compact for dispensing product on blister cards, such as medication or the like, that fully satisfies all of the objects and aims previously set forth. The disclosure has been presented in connection with several exemplary embodiments, and a number of additional modifications and variations have been described. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A child-resistant compact for dispensing product on blister cards, which includes:

a first portion having a first panel hinged to a first clamp for capturing an end of a first blister card, a base wall, sidewalls extending along the base wall, and an endwall extending between said sidewalls, a second portion having a second panel hinged to a second clamp for capturing an end of a second blister card, means connecting said first and second clamps to each other such that said first and second panels form a closable cavity for enclosing the blister cards, at least one child-resistant latch on peripheries of said first and second panels for opening one or both of said panels with respect to said clamps for access to blister cards captured by said clamps, wherein said at least one child-resistant latch includes a first latch opposite said clamps including a latch arm extending from said base wall of said first portion and disposed in a gap in said end wall;

a reinforcing wall integral with said base wall and said end wall and spaced from said end wall adjacent to said latch arm to strengthen said first panel against bending upon activation of said latch arm; and at least one reinforcing rib extending between said latch arm and said reinforcing wall to strengthen said latch arm.

2. The compact set forth in claim 1 wherein said first portion and said second portion are of separate molded plastic constructions.

3. The compact set forth in claim 1 wherein said first portion and said second portion together are of one-piece integrally molded plastic construction, said means comprising a hinge integrally connecting said first and second clamps.

4. The compact set forth in claim 1 further comprising a guide adjacent to said latch for aligning said panels as said panels are closed toward each other, wherein said guide includes at least one guide post on said second panel for receipt between said end wall and said reinforcing wall of said first panel to promote engagement of said latch.

5. The compact set forth in claim 4 wherein said at least one guide post includes an angled free end so that engagement between said at least one guide post and at least one of said end wall or said reinforcing wall cams said panels into alignment.

6. The compact set forth in claim 5 including a pair of said guide posts on one of said panels on opposite sides of said latch.

7. The compact set forth in claim 1 wherein said at least one child resistant latch includes second latches disposed on opposite sides of said first and second panels.

8. The compact set forth in claim 7 wherein said second latches include latch arms on said first panel extending from said base wall through associated recesses in said sidewalls and having outwardly convex wall portions depressible to release said latch arms, and latch apertures in said sidewalls and at least partially defined by sections of said sidewalls having cam surfaces for engagement by said latch arms to cam said latch arms inwardly until said outwardly convex wall portions of said latch arms snap into said apertures when said panels are fully closed.

9. The compact set forth in claim 8 wherein said outwardly convex wall portions have rounded outer surfaces for engagement with said cam surfaces.

10. The compact set forth in claim 9 wherein said first panel includes a reinforcing wall adjacent to each latch arm of said second latches to strengthen said first panel against bending upon activation of said second latches.

11. The compact set forth in claim 10 including at least one reinforcing rib extending between each said latch arm of said second latches and the adjacent reinforcing wall.

12. A child-resistant compact for dispensing product on blister cards, which includes:

a first portion having a first panel hinged to a first clamp for capturing an end of a first blister card, a second portion having a second panel hinged to a second clamp for capturing an end of a second blister card, means connecting said first and second clamps to each other such that said first and second panels form a closable cavity for enclosing the blister cards, and at least one child-resistant latch on peripheries of said first and second panels for opening one or both of said panels with respect to said clamps for access to blister cards captured by said clamps, wherein said first clamp includes a first pair of parallel clamp members molded integrally with said first panel and interconnected by a hinge to said first panel, and wherein said second clamp includes a second pair of parallel clamp members molded integrally with said second panel and interconnected by a hinge to said second panel, said first and second pairs of parallel clamp members including first clamp members integrally joined to said first and second panels by said hinges and second clamp members integrally joined to said first clamp members by hinges, said first and second clamp members each including cooperating clamp elements to capture said blister cards.

13. The compact set forth in claim 12 wherein said first and second portions are of separate molded plastic constructions, and wherein said means includes connectors on said first and second clamps connecting said first and second clamps to each other.

14. The compact set forth in claim 12 wherein said first portion and said second portion together are of one-piece integrally molded plastic construction, said means comprising a hinge integrally connecting said first and second clamps.

* * * * *